US008047886B1

(12) United States Patent
McLarty et al.

(10) Patent No.: US 8,047,886 B1
(45) Date of Patent: Nov. 1, 2011

(54) ROUND TUBE BOAT

(76) Inventors: Richard W. McLarty, Hurst, TX (US); Linda L. McLarty, Hurst, TX (US)

( * ) Notice: Subject to any disclaimer, the term of this patent is extended or adjusted under 35 U.S.C. 154(b) by 174 days.

(21) Appl. No.: 12/349,961

(22) Filed: Jan. 7, 2009

Related U.S. Application Data

(60) Provisional application No. 61/006,328, filed on Jan. 7, 2008.

(51) Int. Cl.
*B63B 1/00* (2006.01)

(52) U.S. Cl. ..... 441/66; 441/67; 114/346

(58) Field of Classification Search ..... 114/346, 114/345; 441/66, 67
See application file for complete search history.

(56) References Cited

U.S. PATENT DOCUMENTS

| | | | | | |
|---|---|---|---|---|---|
| 3,665,534 | A | * | 5/1972 | McIntyre | 114/343 |
| 4,021,873 | A | | 5/1977 | Francois | |
| 4,305,170 | A | * | 12/1981 | Atherton | 114/346 |
| 4,367,689 | A | * | 1/1983 | Lukehart et al. | 114/346 |
| 4,516,943 | A | * | 5/1985 | Spieldiener et al. | 441/35 |
| 5,052,955 | A | | 10/1991 | Shiratori | |
| 5,176,546 | A | | 1/1993 | Shiratori | |
| 5,297,978 | A | * | 3/1994 | Ramsey | 441/131 |
| 5,331,914 | A | | 7/1994 | Salmons | |
| 6,269,587 | B1 | * | 8/2001 | Wallace | 43/54.1 |
| 6,543,378 | B1 | | 4/2003 | Johnson | |
| 6,962,124 | B1 | | 11/2005 | North et al. | |

* cited by examiner

*Primary Examiner* — Stephen Avila
(74) *Attorney, Agent, or Firm* — Guy V. Manning

(57) ABSTRACT

A round boat has a one-piece, open-topped hull having a substantially flat bottom and outwardly concave but substantially vertical sides surmounted by flared gunnels. The concave sides mate with the inner walls of a toroidal-shaped flotation device, such as an inflated bladder, or tube, which fills the concavity and supports the hull. The tube and the hull are substantially coplanar such that cargo and passengers are supported within the toroidal opening of the tube. The tube and hull may be provided with a covering, or sheath, to help protect the tube from unnecessary wear or damage, and to provide means for replaceable decoration or identification. At least one seat is mounted to and projects radially inward from the gunnels to center the weight of a passenger above the hull, thereby increasing stability of the boat with the added weight of each additional passenger. The seat may include a swivel for convenience of movement. Also mounted to the gunnels and projecting radially outward over the tube, motor mount means supports a lateral transom for mounting an outboard motor to serve as both propulsion and steering. A tray projecting inward from the motor mount means includes cavities for small articles such as fishing lures, drinks or navigation equipment. A battery compartment mounted on the hull floor provides propulsion energy. A two-person boat as described is light weight and can be lifted by one person and rolled on its side for loading and unloading. The tube may be deflated for storage.

19 Claims, 7 Drawing Sheets

ROUND TUBE BOAT

This application claims priority from a Provisional Application Ser. No. 61/006,328, filed Jan. 7, 2008.

BACKGROUND OF THE INVENTION

1. Field of the Invention

This invention relates to water craft generally, and particularly to small, personal, leisure water craft. More particularly, this invention relates to a round, two-person boat having an inner, circular cockpit surrounded by a coplanar, toroidally-shaped floatation means.

2. Description of Related Art

Designs for small water craft generally can be grouped by their propulsion means, hull characteristics, sizes and purposes. Among small, leisure water craft, both flat-bottom boats and those with V-hulls are common, both typically having a distinct fore and aft which may be pointed or squared for mounting a motor. Barges and rafts by contrast usually have substantially squared ends and may or may not have a distinct stem and stern. Barges generally have non-watertight hulls and rely on weight displacement for flotation. Rafts by contrast rely upon the inherent flotation of their components, such as wood, closed-cell foam or air-tight structures such as barrels or rubberized tubes. Water craft design has for centuries explored the limits of these parameters, but a hybrid craft having characteristics of several others would be useful.

Small boats made from readily available flotation materials are common. Most, however, place mats or decks atop the flotation materials, and as a result suffer from several defects. First, they commonly are top-heavy and vertically unstable, having greater mass above the deck than below. Second, they depend heavily upon the integrity of the flotation materials. Should the flotation fail (e.g. an air-tight barrel becoming flooded), the boat will list seriously toward the defective flotation, further compromising stability. Thus, flotation requires constant vigilance and maintenance. A need exists for a hybrid water craft which, in an emergency, can float on its own without flotation material support.

Most personal water craft are large and represent significant storage problems. The typical bass boat, pirogue or flat-bottomed john boat is 10-15 feet long and rather heavy. Many require trailers for transportation, and they occupy considerable real estate during storage. A need exists for a small, personal water craft that easily may be transported and stored.

SUMMARY OF THE INVENTION

Accordingly, it is an object of this invention to provide a personal water craft that is small and easily transported and stored.

It is another object of this invention to provide a personal water craft that relies upon readily available flotation materials yet doesn't depend entirely upon them for flotation.

It is yet another object of this invention to provide a personal water craft that utilizes inflatable flotation materials.

It is yet another object of this invention to provide a personal water craft that is stable in the water.

It is yet another object of this invention to provide a personal water craft that is a hybrid of weight displacement and external flotation means for buoyancy.

The foregoing and other objects of this invention are achieved by providing a round boat having a one-piece, open-topped hull having a substantially flat bottom and outwardly concave but substantially vertical sides surmounted by flared gunnels. The concave sides mate with the inner walls of a toroidal-shaped flotation device, such as an inflated bladder, or tube, which fills the concavity and supports the hull. The tube and the hull are substantially coplanar such that cargo and passengers are supported within the toroidal opening of the tube. The tube and hull may be provided with a covering, or sheath, to help protect the tube from unnecessary wear or damage, and to provide means for replaceable decoration or identification. At least one seat is mounted to and projects radially inward from the gunnels to center the weight of a passenger above the hull, thereby increasing stability of the boat with the added weight of each additional passenger. The seat may include a swivel for convenience of movement. Also mounted to the gunnels and projecting radially outward over the tube, motor mount means supports a lateral transom for mounting an outboard motor to serve as both propulsion and steering. A tray projecting inward from the motor mount means includes cavities for small articles such as fishing lures, drinks or navigation equipment. A battery compartment mounted on the hull floor provides propulsion energy. A two-person boat as described is light weight and can be lifted by one person and rolled on its side for loading and unloading. The tube may be deflated for storage.

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
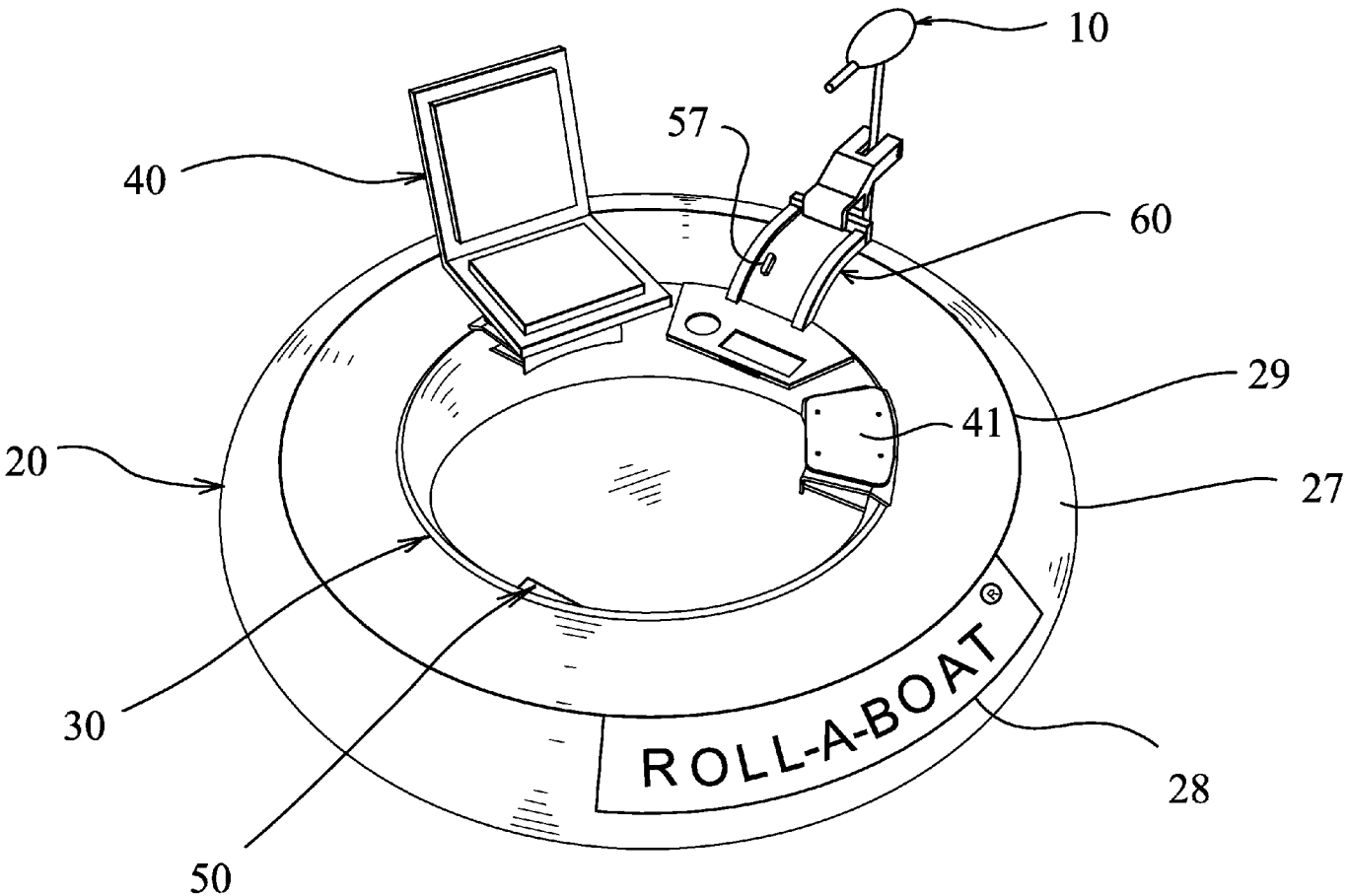
FIG. 1 depicts in left quartering perspective of a preferred embodiment of present invention.
Figure 2:
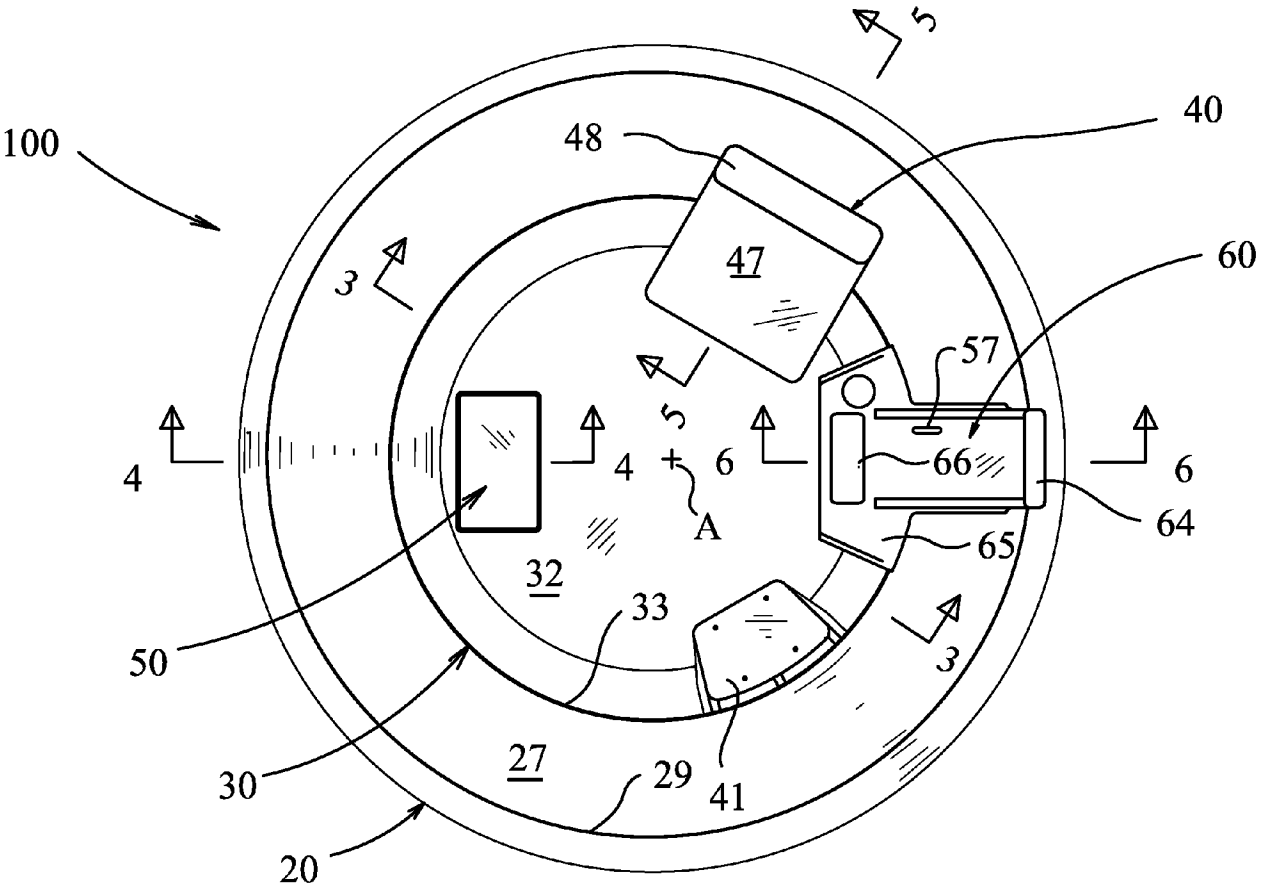
FIG. 2 shows a top plan view of the embodiment of the invention in FIG. 1.

With reference now to the figures, and in particular to FIGS. 1-3 and 7, a preferred embodiment of the present invention comprises boat 100 adapted for use as a small, personal water craft on waterways such as lake 3. Boat 100 comprises round hub 30 surrounded by flotation means 20, both sharing a common vertical axis A and a planar horizontal axis B. In the embodiment depicted in the figures, boat 100 is round in a horizontal plane parallel to axis B, and is symmetric about any vertical plane extending through axis A. Thus, boat 100 as depicted has no inherent stem or stern except as defined by the location of motor mount 60 which, by convention but not by necessity, could be considered disposed at the stern of boat 100. One having ordinary skill in the art will recognize that boat 100 can comprise other shapes (not shown) such as oval, rectangular, square or other shapes which may or may not include a defined bow and stern.

Figure 3:
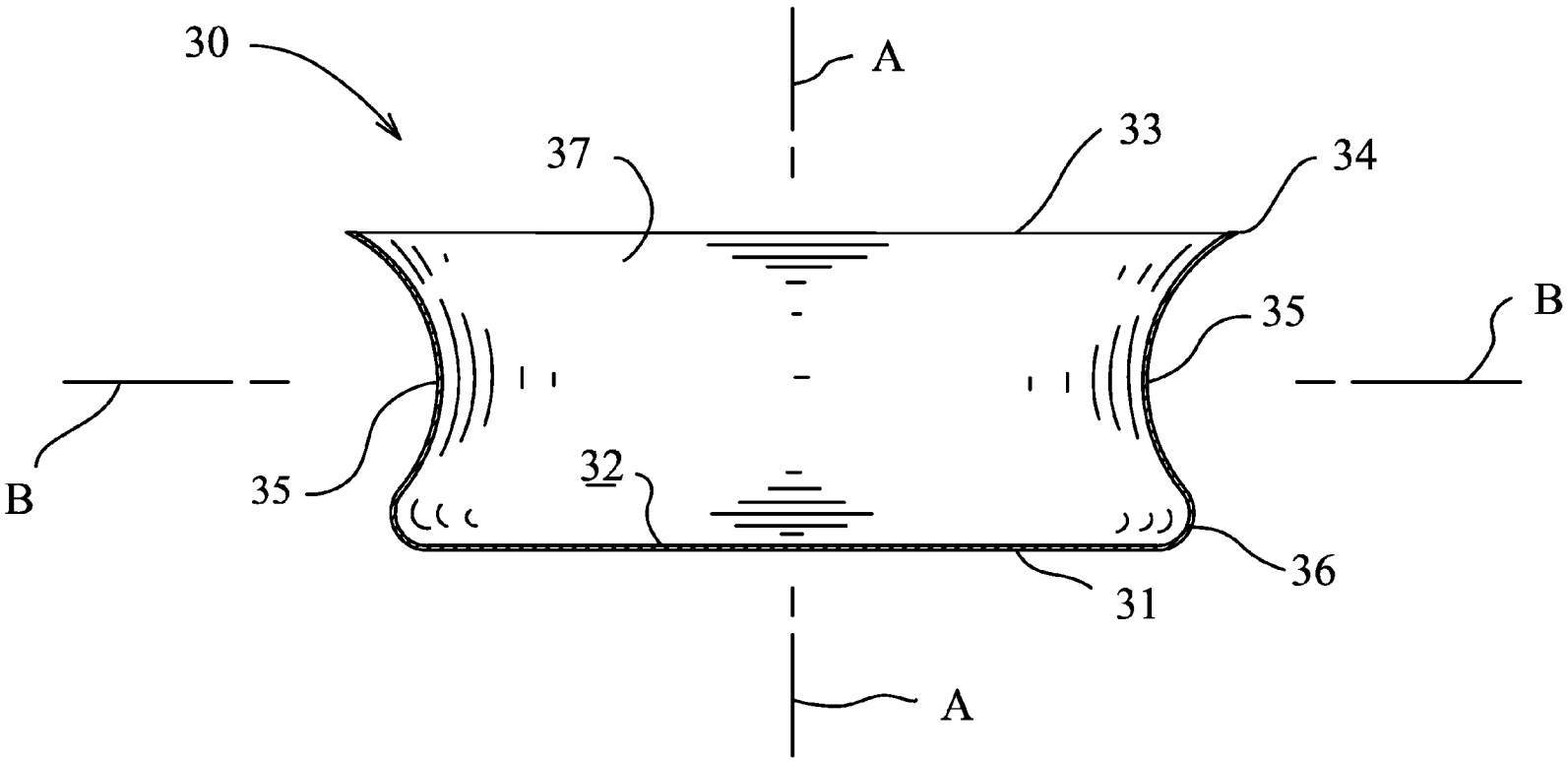
FIG. 3 depicts in side elevational cross section, as indicated in FIG. 2, the inner hub portion of the present invention of FIG. 1.

As best seen in FIG. 3, hub 30 comprises substantially cup-shaped interior that spans between opposite, inner surfaces 23 of flotation means 20. Hub 30 includes outwardly concave sides 35 which surround and define interior 37 which, except for floor 32, is substantially symmetric about horizontal axis B. Hub 30 has its shortest horizontal radius at axis B. A suitable diameter for a two-person boat 100 as depicted in the figures is between forty-four and forty-eight (44"-48") inches. One having ordinary skill in the art will recognize that alternate vertical profiles (oriented as in FIG. 3) of sides 35 may be utilized without departing from the spirit and scope of the present invention.

Figure 4:
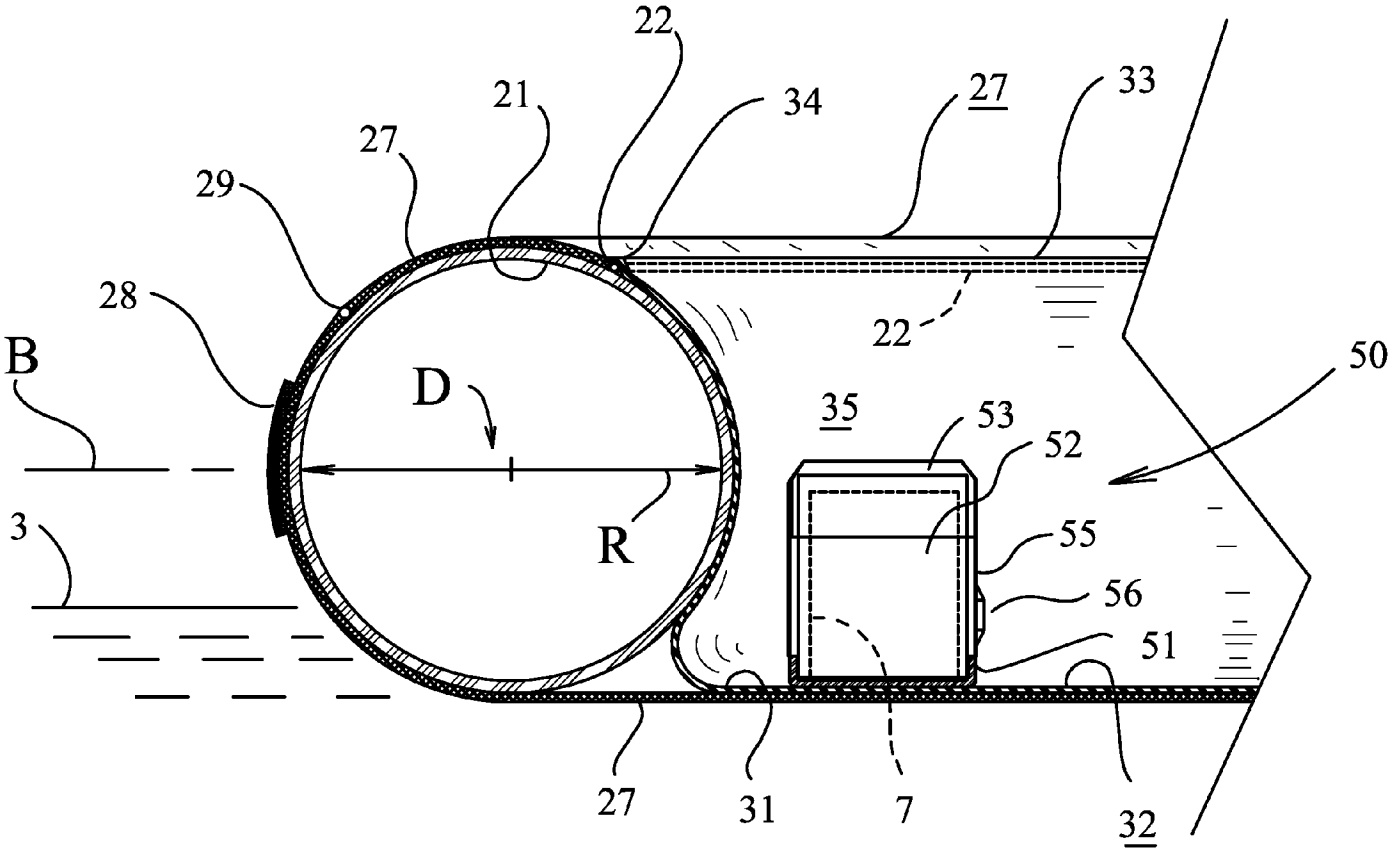
FIG. 4 details in cutaway section, as indicated in FIG. 2, a sheath cover and battery storage system provided with the present invention of FIG. 1.

Sides 35 extend downward from axis B while flaring radially outward to a maximum radius for floor 32 where rounded heels 36 turn inwardly to become substantially flat bottom 31. Sides 35 extend upward from axis B and flare similarly, but terminate at gunnels 33. Preferably, sides 35 are approximately seventeen (17") inches high from floor 32 to gunnels 33. At this height, seating means 40, discussed in detail below, is elevated above floor 32 a conventional height to accommodate most users (not shown) seated therein with their feet comfortably resting on floor 32. Heels 36 and bottom 31 are substantially flush with bottom surface 26 of flotation 20 (see FIG. 4) such that neither is supported by the other when boat 100 rests on a horizontal surface.

The overall diameter of boat 100 preferably lies between five (5) and eight (8) feet, and the minimum diameter of hub 30 (at axis B) is between three (3) and six (6) feet respectively. One having ordinary skill in the art will recognize, of course, that the overall height and diameter of boat 100 may vary considerably from these parameters without departing from the spirit and scope of the present invention. The larger said overall diameter of boat 100, the more seating means 40 and accordingly the more passengers boat 100 can accommodate.

The radius of gunnels 33 is substantially the same as heels 36, and extends radially outward from the minimum radius at axis B a distance at least half the cross-sectional radius R (see FIG. 4) of flotation 20. Thus, when flotation means 20 is installed within the concavity of sides 35, hub 30 is affixed at axis B within the toroidal aperture of flotation 20 and cannot shift vertically (along axis A) in either direction relative to flotation means 20. This prevents hub 30 from dropping through flotation 20 (parallel to axis A) under the weight of cargo and passengers.

The concavity of sides 35 preferably is circular in shape and adapted to mate with the cross-sectional circumference (see, e.g., FIGS. 4-6) of toroidally shaped flotation means 20. In the preferred embodiment, flotation means 20 comprises a flexible, inflatable bladder, such as an inner tube 21 from a large land vehicle like a truck, tractor or earth moving machine. For hub 30 having a diameter of forty-four (44") inches, a suitable size for tube 21 is 16.9R18.4R38. Tube 21 is circular in cross-section with inner and outer surfaces 23, 24 and top and bottom surfaces 25, 26 (see FIG. 4). One having ordinary skill in the art will recognize, of course, that flotation means 20 could comprise materials other than tube 21, such as closed-cell foam (not shown), without departing from the spirit and scope of the present invention. One having ordinary skill in the art also will recognize that tube 21 need not be borrowed from the land vehicle industry in the form of tire inner tubes, but could be tailor made for boat 100 from a variety of flexible, inflatable materials available for the purpose.

Tube 21 further may include sheath 27 (FIGS. 1, 2 4) to help protect it from injury and unnecessary wear, especially on tube 21 surfaces 24, 26 and bottom 31 which are most prone to come into contact with the environment. Sheath 27 comprises one or more webs of fabric sewn together (e.g. at seam 29) to form a circular pocket opening upward at mouth 22 (see FIG. 4) and extending to surround and engage surfaces 24, 25 and 26 (see FIG. 5) of tube 21 and then across and enclosing bottom 31 of hull 30. Mouth 22 may terminate at its margin in a perimeter bead (see FIG. 4) to deter fraying. When installed on boat 100, mouth 22 and said perimeter bead fit snugly beneath lip 34 and are held in place by gunnels 33, thus completely covering tube 21.

When provided, sheath 27 also can employ a plurality of panels of different colors, separated by seams 29, to enhance the aesthetic appeal of boat 100. Sheath 27 also may include a plurality of messages or other indicia for personalization of boat 100 (e.g. a vessel name or owner's identification), for advertising or a trademark (FIG. 1), for simple decorations (not shown), or any combination thereof. When so furnished, the messages or indicia may be borne on separately attached panels 28 (FIGS. 1, 4), or simply printed or painted on the outer surface of sheath 27. One having ordinary skill in the art will recognize that other modes of providing messaging and other indicia features may be employed without sheath 27, such as paint applied directly to tube 21, without departing from the spirit and scope of the present invention.

When inflated, tube 21 expands to fill sides 35 and to stretch vertically above gunnels 33 a small distance. More importantly, tube 21 stretches and expands radially outward from axis A to increase by a substantial margin the diameter of boat 100, filling sheath 27 in the process if it is employed. Preferably, tube 21 increases the diameter of boat 100 by at least half (50%), lending considerable horizontal stability to boat 100 when it is in the water. Further, hub 30 can float upright without flotation 20, and could manage to stay aright long enough for a user (not shown) to paddle carefully back to shore should a mishap occur which deflates tube 21. However, boat 100 would sit considerably lower in the water, with significantly less freeboard (distance above water 3 of gunnels 33) for a given cargo or passenger load. With flotation 20 in place, boat 100 floats significantly higher in the water and can carry significantly more cargo than without flotation 20. Preferably, boat 100 with flotation 20 in place, can carry two large adults seated in seats 40, along with their accouterments (e.g. fishing gear), trolling motor 10 and battery 7, without seriously being in jeopardy of tipping or sinking. Also, by sitting higher in water 3, boat 100 can move across water 3 with less resistance, and can achieve higher speeds, than if sitting low in the water. Because its cargo is carried inside hub 30, however, boat 100 remains stable and unlikely to tip over.

Figure 5:
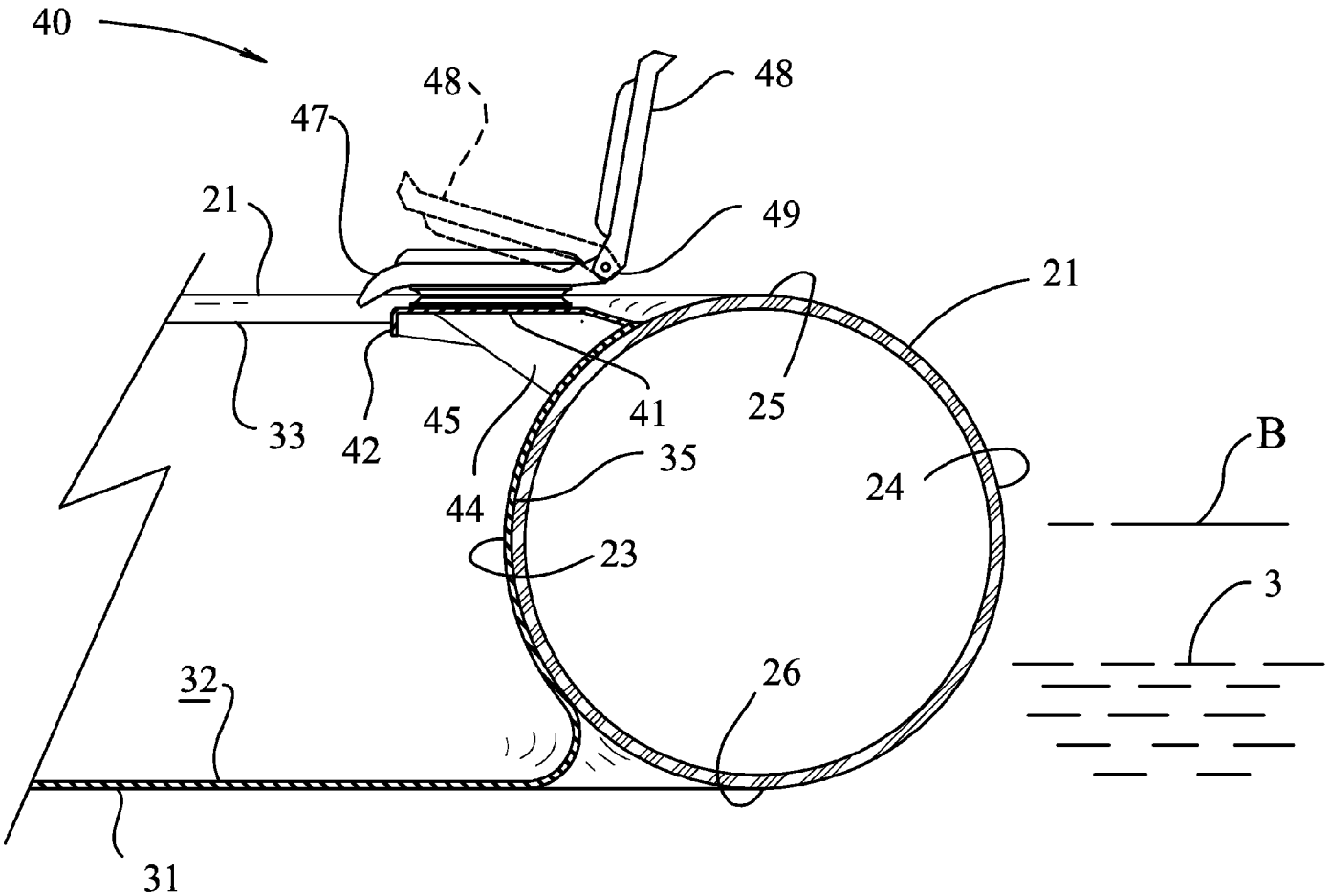
FIG. 5 details in cutaway section, as indicated in FIG. 2, the seating provided with the present invention of FIG. 1.

Turning now also to FIG. 5, seating means 40 comprises a plurality of platforms 41 coupled to gunnels 33 and disposed radially inward toward axis A to form a base for each seat bench, 47. Braces 44 extend downward and radially outward from flanges 42 of platforms 41 to couple to sides 35, thereby to brace seating means 40 against the weight of a passenger or operator (user) seated (not shown) in seating means 40. Disposed between each bench 47 and platform 41, rotation means, or swivel, 45 may be provided to allow bench 47 to rotate horizontally above platform 41. Preferably swivel 45 provides full 360 degree rotation to seat 47 to maximize the user's ability to address helm 14 of motor 10 and to direct his attention in other directions for fishing or steering boat 100. Bench 47 and platform 41 preferably retain the mass and center of gravity of a seated user within the radius of gunnels 33 so that the user's weight augments stability of boat 100 instead of tipping it excessively. Seat backrest 48 hingedly couples to one edge of bench 47 and enhances comfort of seats 40 when provided, but one having ordinary skill in the art will recognize that backrest 48 is not required. Backrest 48 folds downward to lay substantially flat atop seat bench 47 when not in use and when boat 100 is being transported, as discussed in detail below.

The more directly across from each other two users (not shown) are positioned, the better their respective weights offset each other and serve to keep boat 100 level in water 3. Accordingly, where more than one seating means 40 is provided, preferably each is disposed axially around gunnels 33 from the others a distance of between ninety and one hundred twenty (90-120) degrees. Preferably, one seating means 40 is provided on either side of motor mount 60 such that either user could manipulate helm 14 should the other be otherwise occupied. With this configuration, battery mount means 50 (FIG. 6) preferably is mounted diametrically opposite motor mount 60 further to balance boat 100.

Figure 6:
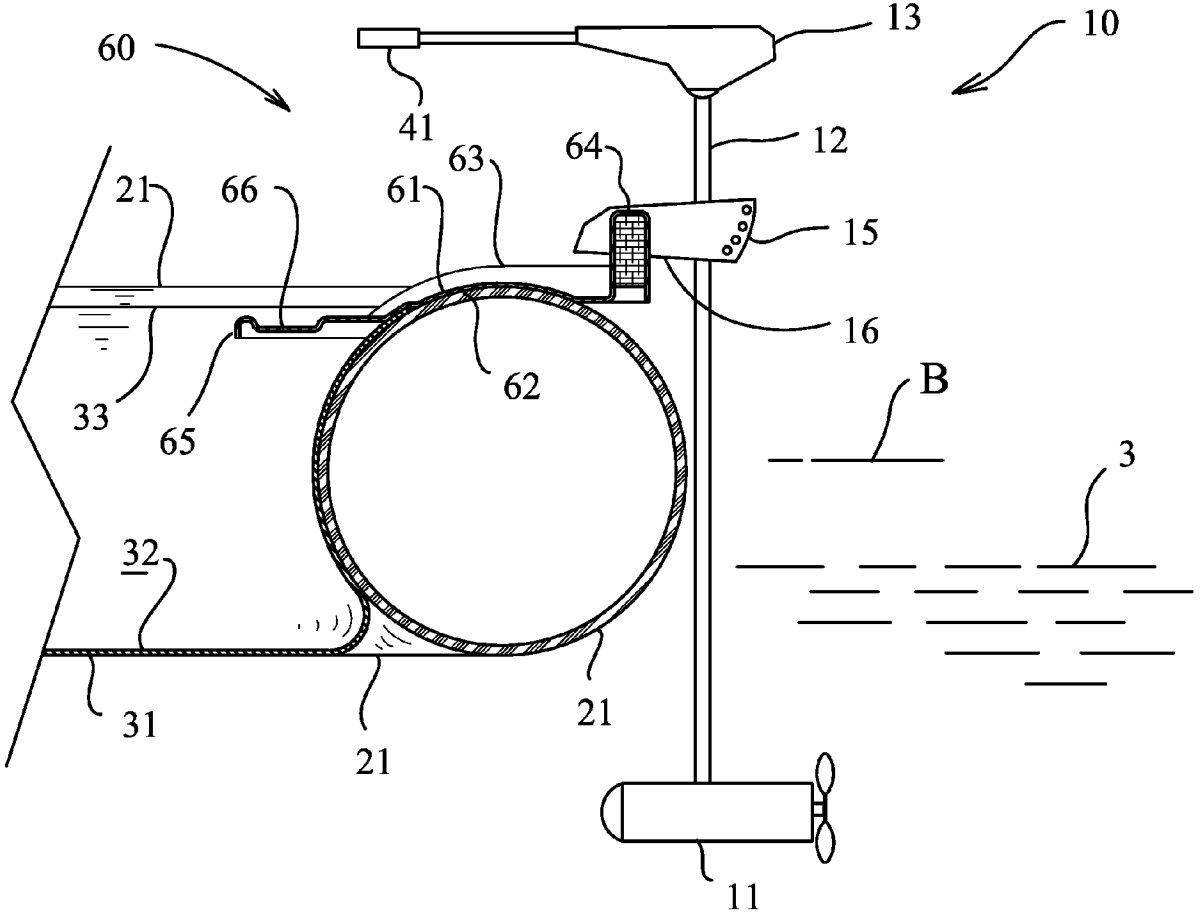
FIG. 6 details in cutaway section, as indicated in FIG. 2, a motor mount provided with the present invention of FIG. 1.

Turning now to FIG. 6, motor mount means 60 disposed atop gunnel 33 extends radially outward across flotation means 20 a substantial portion of, but less than, its cross-sectional diameter. Motor mount 60 comprises plate 61 with its lower surface contoured concave-downward to engage surface 25 and to match the cross-sectional circumference of tube 21. Reinforcing ribs 63 disposed on either side of plate 61 extend radially outward from gunnels 33 to terminate in transom 64 disposed substantially tangent to the circumference of boat 100. Disposed radially inward from gunnel 33, tray 65 couples to plate 61 for convenience of users and includes a plurality of shallow dishes 66 for placing fishing gear or other small objects. Physical mounts (not shown) for other equipment, such as an electronic depth finder or running lights (neither shown) may be provided between ribs 63 atop plate 61. At least one battery power terminal 57 coupled to battery means 50 (discussed in detail below) is disposed on mount 60 (see FIGS. 1, 2) for connecting electric equipment, including outboard motor 10, discussed below.

Since plate 61 spans most of flotation 20, transom 64 is displaced radially outward from gunnels 33 almost to the outer perimeter of boat 100. This permits bracket 15 of trolling motor 10 to clamp to transom 64 with shaft 12 depending vertically into water 3. This places motor 11 substantially horizontal beneath bottom 31 where the user can rotate it using helm 14. Control and power wiring (not shown) extends from controller 13 to motor mount 60 where it connects to battery terminal 57 and thereby to battery 7 within battery mount 50. A foot-operated speed control (not shown) may be provided on floor 32 near side 35 opposite battery mount 50 (i.e. beneath motor mount 60) for the operator to regulate the speed of motor 11. Alternately, helm 14 may include a speed control, obviating the need of a foot pedal control.

Turning now again to FIG. 4, battery mount means 50 is shown disposed on floor 32 of hub 30 adjacent side 35 and, preferably located diametrically across hub 30 from motor mount 60, as discussed above. Battery mount 50 comprises upwardly open, flat cup 51 with short walls defining a shallow interior. Battery mount 50 is bolted (not shown) or otherwise bonded to floor 12 so that it cannot move. Cup 51 is substantially rectangular in shape and adapted to receive the rectangular bottom of battery 7 to prevent battery 7 from sliding around on floor 12. Battery box 52 surrounds battery 7 and nests within cup 51, while cap 53 covers the top and terminals (not shown) of battery 7 to prevent the latter from being splashed with water. Strap 55 couples from one side of cup 51, across cap 53 and down to the opposite side of cup 51 to hold in place cap 53 and box 52 with battery 7 inside. Strap 55 may include buckle 56 for tightening of strap 55, as is known in the art.

Referring now again to FIG. 7, boat 100 as described above preferably is sized such that it easily can be carried in a personal vehicle such as a pickup truck or sports utility vehicle (SUV). The overall radius of boat 100 with flotation 20 installed is large enough to rest on the sides of bed 6 of truck 7 while being small enough not to protrude beyond the sides of bed 6 so far as to impede travel on the highways. If tube 21 is deflated, hub 30 may lie flat and entirely within bed 6 without protruding at all. As hub 30 preferably is less than two feet deep from bottom 31 to gunnels 33, boat 100 nests well below the top rails of bed 6 of most pickup trucks 5 when tube 21 is deflated.

Figure 7:
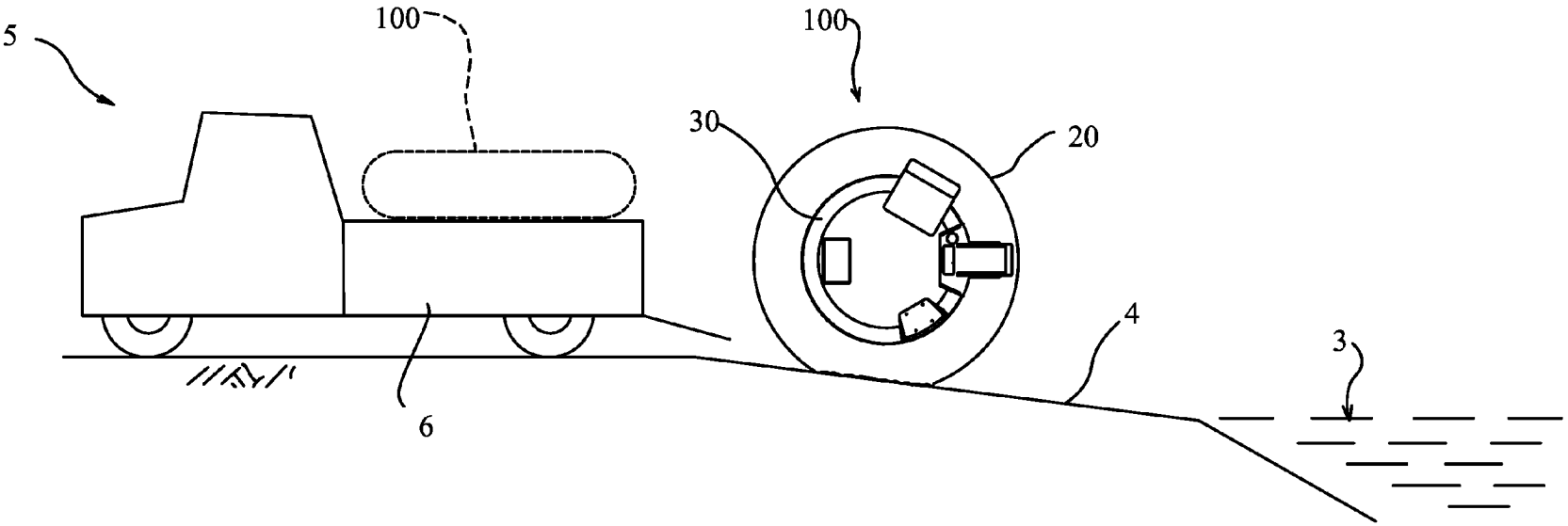
FIG. 7 depicts the present invention of FIG. 1 being loaded and/or unloaded from a vehicle for transportation and/or for use.

As shown in FIG. 7, boat 100 also may be removed from bed 6 of truck 5 and rested on the outer perimeter surface 24 of flotation 20 whereupon it then may be rolled to lake 3 for use. When the operator is finished with it, boat 100 likewise may be rolled on surface 24 back to truck for transportation to its storage location (not shown). Even though tube 21 will compress and deform on its surface 24 bearing its weight (FIG. 7), because seat 47 and motor mount 60 do not extend from gunnels 33 as far as the outer perimeter of tube 21, they will not interfere with or become damaged by this rolling operation. Further, boat 100 weighs less than seventy (70 lbs.) pounds, making it easily manipulable by a single adult operator. Alternately, of course, boat 100 may be lifted by its heels 36 by two or more persons and carried instead of rolled.

Preferably, hub 30 is fabricated from high-impact, ABS plastic, blow- or vacuum-molded in one piece without requiring assembly. Seat platforms 41, seat braces 44 and motor mount 60 also preferably are fabricated from high-impact, ABS plastic and bonded to gunnels 33 and sides 35 using high strength epoxy or other permanent bonding means. Alternately, they may be provided with flanges (not shown) disposed such that they lie against gunnels 33 and sides 35 as needed to permit mechanical attachment such as stainless steel bolts.

Seat swivels 45 are available commercially; a suitable swivel is Model no. Q02-1225 (Style 706) manufactured by Action Products and available from Academy Sports Centers nationwide. Cup 51 and battery box 53 with strap 55 also are commercially available as Parts no. BH-27P and HM-300-BK respectively from EverStart Marine (a private brand of Wal-Mart, Inc. of Bentonville, Ark.), and available in Wal-Mart stores nationwide. Where flotation means 20 comprises inner tube 21, it preferably comprises a thick gauge, neoprene bladder available as Part no. 543-136 from Firestone Tires nationwide. When provided, sheath 27 surrounding tube 21 preferably is fabricated from acrylic-coated polyester marine fabric available under the trade name Sea-Sprae from Rockywood Fabrics of Loveland, Colo.

In operation, an operator (not shown) unloads boat 100 from truck 5 and places it on a convenient, nearby horizontal surface. If sheath 27 is to be used, the operator places boat 100 with its bottom 31 down and substantially centered within mouth 22 of sheath 27. While smoothing and evening out sheath 27 around tube 21 and making sure that mouth 22 remains juxtaposed to lip 34, the operator couples an air pump to tube 21 and inflates it to approximately eight pounds (8 psi) per square inch. When tube 21 is entirely inflated, mouth 22 is disposed beneath lip 34 and sandwiched between gunnels 33 and tube 21, thus securing sheath 27 to boat 100 and completely covering all otherwise exposed parts of tube 21 as well as bottom 31.

The operator next rolls or otherwise carries boat 100 to lake 3 or a pier (not shown), places it in the water with bottom 31 down, and tethers boat it by convenient means so he can retrieve his gear, including trolling motor 10 and battery 7, and place it within interior 37 of hub 30. The operator then steps onto floor 32 of boat 100 and unfolds backrest 48 of one of seats 47 adjacent to motor mount 60 so he can sit down. He then lifts trolling motor 60 onto transom 64 and secures it with clamp 16 so that shaft 12 extends vertically downward with motor 11 submerged and helm 14 extending radially inward toward hub 30. The operator next straps battery 7 into battery mount 50 and wires controller 13 to battery 7 to provide energy to motor 11. At this juncture, the operator may load additional gear, passengers or the like, un-tether boat 100 and proceed to enjoy it on lake 3 until he is ready to return.

Upon re-docking boat 100, and after any passengers have debarked and cargo and other gear have been removed from hub 30, the operator prepares boat 100 for removal from the water and transportation. He first uncouples battery 7 from controller 13 and removes trolling motor 10 from transom 64. He then folds down all backrests 48 on seats 47, removes any other materials and steps out of boat 100. Next, the operator removes all loose cargo and equipment and lifts one side of boat 100 until boat 100 rests on one side of floatation 20 with axis A substantially horizontal. The operator then can roll boat 100 up boat ramp 4 to truck 5 and load it into bed 6. If he prefers to deflate tube 21, he may do so on the ground before loading boat 100 into bed 6, or he may first load boat 100 into bed 6 (disposed as shown in phantom in FIG. 7) and then deflate it while he turns to other tasks. Sheath 27 may be removed and stored separately, or it may be left in place to protect and keep clean now deflated tube 21.

The combination in boat 100 of a toroidal shape air bladder with a water-tight hull mounted in its center creates a remarkably stable structure by lowering the center of gravity of the boat's passengers and cargo to within the planar center of gravity of the flotation device instead of atop it as with the typical raft. Boat 100 easily may be transported to and from lake 3 or other waterways in a personal vehicle and may be stored in a garage or other home structure without the need for marina facilities required for many boats. Since it is so light and small, boat 100 does not require a trailer. Boat 100 can be inflated and ready for use in approximately 20 minutes using a small, twelve (12 v.) volt air pump plugged into a cigarette lighter of truck 5. Yet, it is quite stable and hardy. A prototype boat 100 has been tested and proved capable of carrying over four hundred (400 lbs.) pounds, and registered by the Texas Parks and Wildlife Department for use on all Texas waterways, including oceans.

While the invention has been particularly shown and described with reference to preferred and alternate embodiments, it will be understood by those skilled in the art that various changes in form and detail may be made therein without departing from the spirit and scope of the invention. For example, though described as round, boat 100 can be ovate and still rely on large inner tubes 21 for flotation means 20. Tubes 21 typically are resilient enough to conform to sides 35 having long and short axes B as with an ellipse (not shown). Also, boat 100 has been discussed as having a flat bottom 31, but it could have other shapes, such as a regular, downwardly-convex curve (not shown), or it could include ribs or a keel (neither shown) substantially parallel to axis B.

We claim:

1. A personal water craft comprising
- a substantially ovate hull surrounding a vertical axis and having
  - a substantially planar bottom normal to the axis;
  - sides extending from the bottom substantially coaxial with the axis to terminate in gunnels, the sides being outwardly curved to define a concave recess surrounding the hull;
  - flotation means received within the recess;
- a table disposed on and extending radially inward from the gunnels and having
  - a plurality of upwardly facing recesses adapted to receive objects; and
  - mounting means coupled to the table for mounting equipment; and
- at least one platform coupled to the gunnels and extending radially inward toward the axis, each of the at least one platforms having;
  - a seat coupled to a top surface of the platform, the seat having a back edge;
  - swivel means coupled between the seat and the platform for swiveling the seat above the platform; and
  - a backrest hingedly coupled to the seat.

2. The personal water craft of claim 1 wherein the flotation means comprises
- an inflatable tube surrounding the sides and received within the recess.

3. The personal water craft of claim 1 wherein
- the flotation means is substantially coaxial with the hull.

4. The personal water craft of claim 3 wherein
- the flotation means has a lower surface substantially flush with the bottom and an upper surface disposed proximate the gunnels.

5. The personal water craft of claim 1 wherein
- the hull is substantially circular;
- the sides and recess are annular; and
- the flotation means is toroidal in shape.

6. The personal water craft of claim 1 and further comprising
- a motor mount disposed on the gunnels and having
  - a plate coupled to the gunnels and extending radially outward across a portion of the flotation means, the plate having a bottom surface adapted to engage and match the shape of the upper surface of the flotation means;
  - supporting ribs disposed on either side of the plate; and
  - a tangential transom disposed at the end of the ribs distal the gunnels, the transom adapted to support an outboard motor.

7. The personal water craft of claim 1 and further comprising
- a plate coupled to the gunnels and extending radially outward opposite the axis to terminate in a transom;
- an outboard motor mounted to the transom and having
  - a submersible motor coupled to the end of a rotatable shaft;
  - a helm coupled to the shaft and extending radially inward toward the axis;
  - a bracket coupled between the transom and the shaft and adapted to pivot the shaft in a vertical plane between a plurality positions between an operational position with the outboard motor submerged beneath the water and a retracted position;
- power means coupled to the helm and adapted to power the outboard motor to propel the water craft when the shaft is in the operational position.

8. The personal water craft of claim 7 wherein
- the outboard motor is an electrical motor; and
- the power means comprises
  - a battery disposed on the bottom within the hull and enclosed in a battery box;
  - an electrical terminal disposed on the plate; and
  - electrical cabling extending from the battery to the electrical terminal.

9. A personal water craft comprising a circular hull surrounding a vertical axis and having a substantially planar bottom;

outwardly concave sides extending upwardly from the bottom to terminate in gunnels, the sides defining an annular recess surrounding the hull;

a toroidally-shaped, inflatable tube surrounding the hull and received within the recess and having a tube circumference coaxial with the recess; and a protective sheath disposed beneath the bottom and extending vertically to surround the tube circumference, the sheath having an inner surface defining an interior adapted to engage the tube;

an outer surface adapted to bear identification indica for the water craft; and closure means adapted to secure the sheath to the tube and to admit the tube into the interior.

10. The personal water craft of claim 9 and further comprising a motor mount disposed on the gunnels and extending across a portion of the inflatable tube, the mount further having a plate engaging the top surface of the tube;

a rib disposed on each side of the plate;

a transom disposed at the end of the ribs distal the gunnels;

an outboard motor having a shaft pivotally coupled to the transom by a bracket and having an upper and a lower end;

a submersible electric motor disposed on the lower end;

a controller disposed on the upper end and electrically coupled to the motor;

a battery disposed within the hull and electrically coupled to the controller; and a helm extending radially inward from the controller and adapted to both steer and propel the water craft.

11. An improved method of deploying a personal water craft onto a body of water having a water surface, the method comprising providing a water craft having a circular hull surrounding a vertical axis and having a substantially planar bottom;

outwardly concave sides extending from the bottom to terminate in gunnels, the sides defining an annular recess;

at least one seat disposed on the gunnels and having a platform extending radially inward from the gunnels;

a swivel coupled to a top surface of the platform;

a bench coupled to the swivel and adapted to rotate in a plane substantially parallel the bottom; and a backrest hingedly coupled to the bench; and a toroidally-shaped, inflatable tube within the recess, the tube having a tube lower surface and a tube outer surface; then transporting the water craft to a body of water; then inflating the tube until it fills the recess; then lifting the water craft to rest on the tube outer surface; then rolling the water craft to the body of water; then laying the water craft onto the body of water with the hull bottom and the tube lower surface of the tube engaging the water surface.

12. The improved method of claim 11 and including the additional steps of providing a mount disposed on the gunnels and extending radially outward opposite the axis to a transom; and mounting an outboard motor to the transom; then employing the outboard motor to both propel and steer the water craft across the body of water.

13. A personal water craft comprising a substantially ovate hull surrounding a vertical axis and having a planar bottom normal to the axis;

sides extending from the bottom substantially coaxial with the axis to terminate in gunnels, the sides being outwardly curved to define a concave recess surrounding the hull;

flotation means received within the recess;

a motor mount disposed on the gunnels and having a plate coupled to the gunnels and extending radially outward across a portion of the flotation means, the plate having a bottom surface adapted to engage and match the shape of the upper surface of the flotation means;

supporting ribs disposed on either side of the plate;

a tangential transom disposed at the end of the ribs distal the gunnels, the transom adapted to support an outboard motor;

a horizontal table extending radially inward opposite the plate and having a plurality of upwardly facing recesses adapted to receive objects; and mounting means coupled to the table for mounting electronic equipment.

14. A personal water craft comprising a substantially ovate hull surrounding a vertical axis and having a planar bottom normal to the axis;

sides extending from the bottom substantially coaxial with the axis to terminate in gunnels, the sides being outwardly curved to define a concave recess surrounding the hull;

flotation means received within the recess; and at least one seating means coupled to the hull, each seating means having a platform coupled to the gunnels and extending radially inward toward the axis;

a seat coupled to the platform;

swivel means coupled between the seat and the platform for swiveling the seat in a horizontal plane; and a backrest hingedly coupled to the seat and adapted to fold toward the seat for storage.

15. A personal water craft comprising a substantially ovate hull surrounding a vertical axis and having a planar bottom normal to the axis;

sides extending from the bottom substantially coaxial with the axis to terminate in gunnels, the sides being outwardly curved to define a concave recess surrounding the hull;

flotation means received within the recess a protective sheath surrounding the flotation means and the hull bottom, the sheath having a first web surrounding the upper, outer and lower surfaces of the flotation means and having a length equivalent to a circumference of the flotation means;

an inner surface defining an interior adapted to engage the flotation means and the hull bottom; and an outer surface;

a second web mated to the first web adjacent the lower surface of the flotation means and spanning across the hull bottom; and closure means adapted to secure the first web to the flotation means and to admit the flotation means to the interior.

16. The personal water craft of claim 15 wherein the flotation means comprises a toroidally shaped, inflatable tube; and the closure means comprises an open mouth approximately the size of the gunnels and adapted to be disposed beneath the gunnels when the flotation means is installed.

17. A personal water craft comprising a circular hull surrounding a vertical axis and having a planar bottom normal to the axis;

outwardly concave sides extending from the bottom coaxial with the axis to terminate in gunnels opposite the bottom, the sides defining an annular recess surrounding the hull;

a toroidally-shaped, inflatable tube surrounding and substantially coaxial with the hull and received within the recess, the tube having a circumference coaxial with the recess;

a bottom surface substantially flush with the bottom; and a top surface disposed proximate the gunnels; and a plurality of seats arrayed around the axis and disposed on the gunnels, each seat having a platform coupled to the gunnels and extending radially inward toward the axis, the platform having a top surface and a bottom surface;

a plurality of braces coupled between the bottom surface and the hull sides; and a swivel coupled to the top surface;

a bench coupled to the swivel and adapted to rotate in a substantially horizontal plane above the platform; and a backrest hinged coupled to the bench and adapted to fold downward to engage the bench for storage.

18. A personal water craft comprising a circular hull surrounding a vertical axis and having a planar bottom normal to the axis;

outwardly concave sides extending from the bottom coaxial with the axis to terminate in gunnels opposite the bottom, the sides defining an annular recess surrounding the hull;

a toroidally-shaped, inflatable tube surrounding and substantially coaxial with the hull and received within the recess, the tube having a circumference coaxial with the recess;

a bottom surface substantially flush with the bottom; and a top surface disposed proximate the gunnels; and a protective sheath disposed on the tube, the sheath having a web disposed beneath the planar bottom and extending vertically therefrom to surround the tube, the web having a length equivalent to the circumference of the tube;

an inner surface defining an interior adapted to engage the tube; and an outer surface adapted to bear identification indica for the water craft; and closure means extending along the length and adapted to secure the web to the tube and to open to admit the tube into the interior.

19. An improved method of deploying a personal water craft onto a body of water having a water surface, the method comprising providing a water craft having a circular hull surrounding a vertical axis and having a planar bottom normal to the axis;

outwardly concave sides extending from the bottom coaxial with the axis to terminate in gunnels opposite the bottom, the sides defining an annular recess surrounding the hull; and a toroidally-shaped, inflatable tube adapted to surround the hull and to be received within the recess, the tube having an upper and a lower surface and an inner and an outer surface; and providing a sheath adapted to surround the upper, outer and lower surfaces of the tube and the bottom of the hull, the sheath having an interior accessible through a mouth; then transporting the water craft to a body of water; then placing the sheath on a substantially horizontal surface with the mouth directed upward; then placing the water craft bottom down into the sheath interior; then inflating the tube until it fills the recess and is substantially coaxial with the hub, while smoothing the sheath around the tube; and engaging the sheath with the water craft so that the mouth is disposed beneath the gunnels; then lifting the water craft to rest on the outer surface of the tube; then rolling the water craft to the body of water; then laying the water craft onto the body of water with the sheath engaging the water surface.

* * * * *